United States Patent [19]

Banerji et al.

[11] Patent Number: 4,748,001

[45] Date of Patent: May 31, 1988

[54] PRODUCING TITANIUM CARBIDE PARTICLES IN METAL MATRIX AND METHOD OF USING RESULTING PRODUCT TO GRAIN REFINE

[75] Inventors: Abinash Banerji; Winfried Reif, both of Berlin, Fed. Rep. of Germany

[73] Assignee: London & Scandinavian Metallurgical Co Limited, London, England

[21] Appl. No.: 835,747

[22] Filed: Mar. 3, 1986

[30] Foreign Application Priority Data

Mar. 1, 1985 [GB] United Kingdom ..... 8505904
Aug. 2, 1985 [GB] United Kingdom ..... 8519447

[51] Int. Cl.[4] ..... C22C 21/00

[52] U.S. Cl. ..... 420/528; 75/68 R; 420/129; 420/552; 420/590

[58] Field of Search ..... 420/590, 528, 552; 75/129, 68 R

[56] References Cited

U.S. PATENT DOCUMENTS 2,793,949 5/1957 Imich ..... 420/590

*Primary Examiner*—R. Dean
*Attorney, Agent, or Firm*—L. S. Van Landingham, Jr.

[57] ABSTRACT

The invention provides a method of producing an alloy containing titanium carbide particles, the method comprising thoroughly dispersing carbon powder particles into a metal melt, and causing the dispersed carbon particles to react with titanium within the metal melt so as to produce a dispersion of fine particles comprising titanium carbide within the melt. A preferred use for alloys produced by the invention is as a grain refiner for aluminium-based metals, especially those containing zirconium, chromium and/or manganese, which tend to poison current titanium-boron-aluminium grain refiners.

29 Claims, 2 Drawing Sheets

Figure 1:
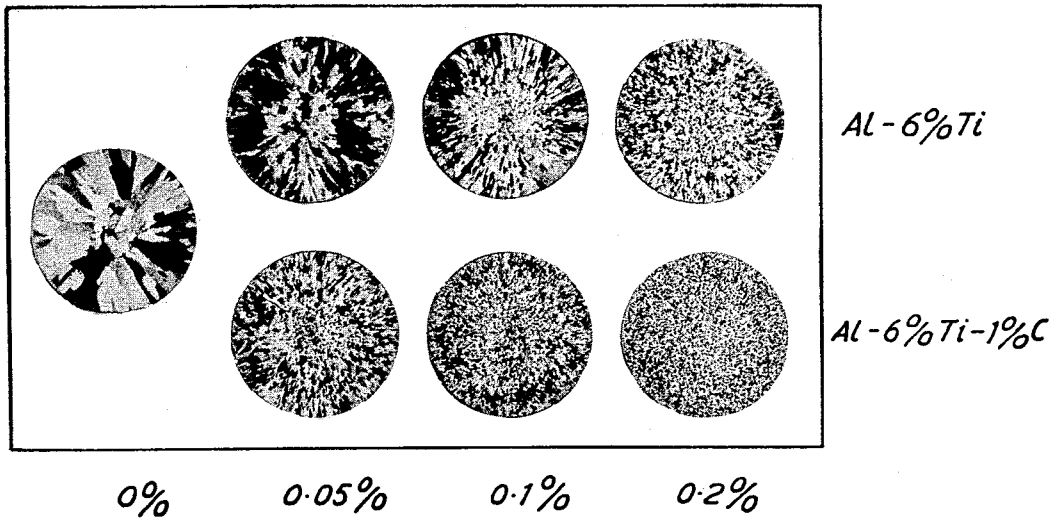

PRODUCING TITANIUM CARBIDE PARTICLES IN METAL MATRIX AND METHOD OF USING RESULTING PRODUCT TO GRAIN REFINE

This invention relates to a method of producing an alloy containing titanium carbide particles, and to the resulting alloy, and to the use of such alloys for grain refining metals.

It is well known that grain refinement can result in considerable improvements in mechanical properties of metals and alloys. In addition, the use of suitable grain refiners can permit a radical increase in casting speeds.

Grain refinement can be brought about by adding a grain refiner to a molten metal prior to casting; the composition of the grain refiner should be such that it promotes the formation of fine grain structure in the cast product, without introducing unacceptable impurities.

Grain refiners have for many years been in use, to a major extent, in the aluminium industry, particularly in the production of ingots, extrusion billets and in sheet fabrication, using either semi-continuous or continuous methods of casting. Without grain refinement, inadequate rates of nucleation would produce coarse structures, which in extreme cases can result in ingot cracking or surface defects such as feather crystals, which are detrimental in the production of sheets or other products requiring a good surface finish.

Widespread industrial practice has empirically established that titanium can produce pronounced grain refinement in aluminium. Further, the grain refining efficiency of titanium can be radically increased when boron is also added to the melt. At present, there are various Al-Ti binary and Al-Ti-B ternary alloys available as commercial grain refiners for aluminium and its alloys, such as the aluminium grain refiners produced by the London and Scandinavian Metallurgical Co Limited.

For over thirty years, it has been thought that trace impurities of titanium carbide can have a grain refining effect in aluminium-based metal melts. (By "aluminium-based metal" is meant herein aluminium itself or an aluminium alloy). Indeed, the literature over the intervening period contains several references to grain refining tests involving the intentional addition of titanium carbide to an aluminium-based metal melt either directly, or via a master alloy. In either case, this has involved producing an alloy containing titanium carbide particles.

In some of these prior proposals, titanium carbide particles have been added, as such, directly to the respective melt; in others, they have been generated in situ in the melt. One proposal for generating titanium carbide within a metal melt has been to add a mixture of potassium fluotitanate and carbon (optionally plus aluminium) to the melt. Another has been to add carbon to an Al-Ti alloy melt, with the aim of reacting the carbon with the titanium content; a very low recovery was achieved, and the grian refinement results were poor.

For a variety of reasons, none of these prior attempts has led to a commercially successful method of grain refinement, or even, so far as we are aware, to any commercial use at all.

In order to produce a commercially viable titanium carbide based way of grain refining, whether the titanium carbide is to be introducd directly into a melt of the metal which is to be grain refined or to be incorporated into an alloy which is to be used as a grain refiner, the method employed should be capable of introducing the titanium carbide into the respective alloy economically, without environmental problems such as evolution of harmful fumes, with good recovery of the source of the carbide (desirable from the point of view of both economy and reproducibility), and in such a manner that the carbide particles are fine and well distributed in the alloy. Also, especially if the resulting alloy is to be used as a grain refiner master alloy, it is important to be able to produce a good concentration of the carbide particles in the alloy.

According to the present invention, there is provided a method of producing an alloy containing titanium carbide particles, the method comprising thoroughly dispersing carbon powder particles into a metal melt, and causing the dispersed carbon particles to react with titanium within the metal melt so as to produce a dispersion of fine particles comprising titanium carbide within the melt.

The present invention is based on the surprising discovery that, in spite of the lack of success of prior attempts over many years, it is possible successfully to produce an alloy containing titanium carbide in a way such as to meet the criteria outlined above, the method involving adding carbon to a metal melt (even though the prior literature has reported poor results with this method), provided that the carbon is added in powder form and is thoroughly dispersed into the metal melt.

The main use of the method of the invention at present envisaged is to produce grain refiner master alloys for use in grain refining aluminium-based metals; these master alloys will generally be aluminium-based. However, it can also be used to introduce titanium carbide particles directly into melts of metals which are to be grain refined, without the use of such master alloys, and furthermore, there will be other situations in which it will be useful to produce titanium carbide-containing alloys by the method of the invention.

We have found that in order to achieve thorough dispersal of the carbon powder particles into the metal melt (ideally with each individual particle being separate from the rest), it is very helpful to introduce the carbon powder into it under such conditions that the carbon powder particles are wetted by the metal melt; ideally every individual carbon particle is fully wetted.

We have further found that wettability of the carbon powder will be substantially enhanced if it is substantially above ambient temperature (preferably 700–900 degrees C., e.g. about 800 degrees C.) when introduced into the metal melt. Preferably, the carbon powder is held at substantially above ambient temperature (preferably 700 to 900 degrees C.) for a prolonged period of time, preferably for at least 0.5 hours, e.g. for 1 hour, before introduction into the melt. We believe that the effect of the pre-heating is to expel the adsorbed moisture from the carbon particles, with an increase in their surface energies, thus promoting reaction between the carbon and titanium. In addition, we believe that removal of moisture releases the hydrogen bonds, thereby causing debonding of the clusters of carbon particles, and at the same time minimising any gas pick-up of the melt.

We have also found that in order to achieve thorough dispersal of the carbon powder particles into the metal melt, it is very helpful to subject the melt to vigorous stirring during introduction of the carbon powder into the melt. The stirring can be produced by mechanical means (e.g. by means of one or more impellers) and/or by electromagnetic means (especially where an induction furnace is already provided to introduce some or all of the titanium into the melt, by reaction of a titanium salt such as potassium fluotitanate, $K_2TiF_6$, with aluminium in the melt). Preferably, sufficient stirring is provided to generate one or more vortices in the melt; the carbon powder can then conveniently be added directly to one or more vortex. In order to facilitate stirring of the melt, it is usually desirable to increase its fluidity, by raising its temperature to give it a suitable degree of superheating.

We also prefer that the metal melt should be stirred at least until substantially no free carbon remains in the metal melt.

Experience has also shown that, in order to aid in wetting of the carbon powder particles, and also to help keep the carbon particles and the subsequently generated carbide particles within the melt, it is highly desirable that the carbon powder should be introduced into the melt through a clean metal melt surface. By this, we mean that at least the zone of the metal surface through which the carbon powder is introduced into the metal melt is free of, in particular, slag, salts, flux and dross; preferably such materials are entirely absent from the melt.

Graphite powder or amorphous carbon powder can be used as the carbon powder to be introduced into the metal melt. Of these, we prefer graphite powder, as it is less prone to loss through oxidation.

Preferably, the carbon powder introduced into the metal melt has an average particle size less than 50 microns, and conveniently may have an average particle size of about 20 microns.

Our tests have shown that it is beneficial to introduce the carbon powder over an extended period of time, rather than introducing it in a single batch.

The carbon powder may conveniently be introduced into the metal melt wrapped in a foil of a metal which is to deleterious to the metal melt. For example, where the metal melt is aluminium-based, the foil may also be one of aluminium or a suitable aluminium alloy.

So far as we are aware, prior attempts to produce alloys containing titanium carbide particles by causing carbon to react with titanium within the alloy have never managed to chemically combine even 1000 ppm by weight into the alloy. Using the method of the invention, one can easily exceed this. Indeed, we have found it possible comfortably to exceed 1% by weight (equivalent to about 5% by weight of TiC), and in fact to exceed 3% by weight (equivalent to about 15 weight % of TiC).

As indicated above, we envisage that the main application of the method of the invention will be to produce grain refiners for aluminium-based metals, and when using the method of the invention for this purpose, the metal melt within which the carbon is to react with titanium will generally be an aluminium-based metal melt.

When destined to be used as a grain refiner for an aluminium-based metal, the alloy produced by the method of the invention may conveniently comprise 3 to 15 weight % titanium, including that which has reacted with the carbon powder, and 0.3 to 3 weight % reacted carbon. Normally, the balance of such an alloy will be aluminium and incidental impurities, but it may, on occasion, be convenient to include in the alloy additional non-deleterious components, such as additional alloying ingredients, for example, or even to base the grain refining alloy entirely on a metal other than aluminium, which other metal will serve as such an additional non-deleterious component. A particularly preferred alloy for this purpose is one comprising about 6 weight % titanium (including that which has reacted with the carbon powder), about 1 weight % reacted carbon, balance aluminium and incidental impurities.

Micrographic analysis of Al-Ti-C alloys produced by preferred methods of practising the invention, as described herein, have shown that the resulting alloys are in the form of carbide particles dispersed in the alpha-Al matrix of the Al-Ti alloy, containing $Al_3Ti$ as a second phase, and that the carbide particles can be substantially of sub-micron size, the sizes of substantially all of the carbide particles falling within the range 0.3 to 1.5 microns, the average size being less than one micron.

Any one of a variety of ways of preparing an aluminium-based metal melt containing titanium for reaction with the carbon particles, when introduced, may be used, for example:

(a) melting a pre-existing solid alloy, such as Al-Ti;
(b) forming a melt from aluminium-based solid and titanium-based solid, by known techniques;
(c) forming an aluminium-based melt by technique (a) or (b) above or by any other suitable means, and introducing titanium (or increasing the titanium content) by introducing into the melt a suitable salt (e.g. potassium titanium fluoride, $K_2TiF_6$) which is capable of reacting with the aluminium in the melt to produce titanium.

If technique (c) is used, the flux-like by-product arising (basically potassium cryolite, where potassium titanium fluoride is used) should preferably be kept away from the carbon powder when added and also the carbide particles produced, conveniently by removing it entirely, as we believe that, when it is present, both the carbon and the carbide particles are preferentially held by the flux-like by-product.

When the reaction of the dispersed carbon particles with the titanium within the metal melt has been taken to the desired extent (normally to substantially 100% reaction of the dispersed carbon), the melt can be cast into the desired from. Where the alloy product is to be used as a grain refiner, it can be cast into convenient shapes, such as waffle plates, to be added batchwise to a melt of the alloy to be grain refined, or it can instead be formed by any of a variety of known means (e.g. casting into ingots, followed by extrusion, or continuously casting, followed by rolling down to a reduced cross-section) into rod, for continuous addition.

The present invention comprehends an alloy, whenever produced by a method in Caccordance with the invention.

The invention also comprehends a method of grain refining an aluminium-based metal, by treating a melt of the metal with an alloy which is in accordance with the invention, and allowing the treated melt to solidify so that carbide particles from the alloy cause refinement of the structure of the thus-treated metal.

We have found that the amounts of the preferred Al-Ti-C master alloys in accordance with the invention described herein required to achieve a given level of grain refinement can be substantially reduced, in comparison with an Al-Ti binary master alloy containing the same amount of titanium. In other words, the amount of titanium addition required to obtain a given grain density across a casting is substantially reduced when such a carbide-containing master alloy is used. We believe that with such master alloys in accordance with the invention, grain refinement is achieved primarily through heterogeneous nucleation of Al or Al alloy grains by TiC particles.

We have also found that these master alloys in accordance with the invention can also very effectively grain refine alloys of aluminium which contain one or more constituents (e.g. zirconium, chromium or manganese) which are known to tend to poison Al-Ti-B grain refiners.

Aluminium-based metals grain refined by the method of the invention can show the usual improvement in properties to be expected on grain refinement, and we have not discovered any unexpected negative effects.

Figure 2:
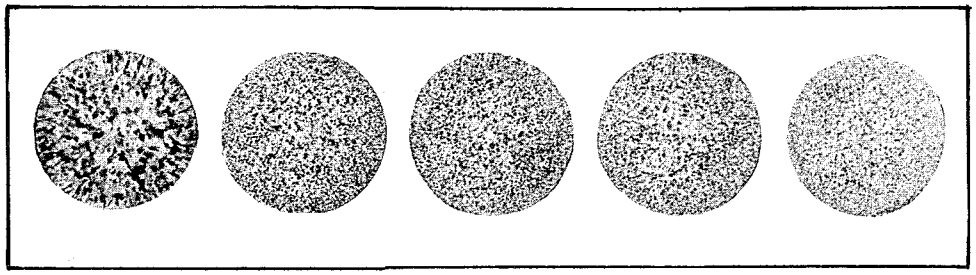

In order that the invention may be more fully understood, some embodiments in accordance therewith will now be described, by way of example only, in the following Examples, with reference to the accompanying drawings, wherein:

FIG. 1 shows optical micrographs, all at a magnification of 0.68:1, of cast aluminium after grain refinement with various levels of addition (including zero) of a conventional Al-6% Ti grain refiner and an Al-6% Ti-1% C grain refiner in accordance with the present invention; and FIG. 2 shows optical micrographs, all at a magnification of 0.68:1, of cast Al-Zn-Mg containing 0.1% zirconium and 0.2% chromium after grain refinement with various levels of addition (including zero) of an Al-6% Ti-1.2% C grain refiner in accordance with the present invention.

EXAMPLE 1

Synthesis of a typical grain refiner containing 6% Ti and 1% C 100 g of an A1-6% Ti alloy was melted in an electrical resistance furnace provided with a movable mechanical stirrer. 1.2 g of graphite powder having an average particle size of 20 microns was preheated in an oven for about 1 hour, to expel the adsorbed moisture and to hold the powder at about 800 degrees C. The melt was superheated to an optimum temperature up to 1000 degrees C. so that an adequate fluidity was obtained. The melt was then mechanically stirred with an impeller of graphite fitted to a clay or ceramic coated steel shaft. The velocity required to create an effective vortex was about 500 rpm. The pre-heated graphite particles wrapped in aluminium foil, were added to the vortex and stirred in. The graphite powder was added gradually to the melt in small batches and directed to the vortex by breaking the oxide layer on the top of the vortex with the help of a graphite shaft. After completion of the graphite addition, stirring was continued for about 15 minutes. Whether carbon has completely reacted or not was ascertained by periodically sampling out the melt and analysing for free carbon. The average recovery of carbon in the melt was about 80% of the input, and thus the addition of 1.2% C resulted in a recovery of about 1% C (equivalent to about 5% TiC).

After adequate stirring, the stirrer was withdrawn and the melt poured into a suitable permanent mould. On a larger scale, it could, for example, have been cast using a continuous casting machine followed by on-line rolling into rod form.

Alternatively, the entire process of addition and reaction of carbon could be performed above 1000 degrees C.; but processing the melt at higher temperatures for sufficient durations requires higher energy input and also causes accelerated oxidation of the melt.

Extraction of the carbide particles in alloys produced by methods such as that described in this Example and electron diffraction studies on them have shown them to be substantially TiC particles, with traces of $Al_4C_3$ and $Ti_3AlC$.

Further, it has been found that, once the carbon has reacted completely, by the treatment described above, if the melt is held for a substantial period of time at temperatures normally used for holding melts of this kind (generally from about 750 to about 1000 degrees C.), then the final cast product can have reduced efficiency as a grain refiner for at least some kinds of aluminium-based metals. We believe that this is because such prolonged holding causes undesirable chemical reactions and preferential segregations of surface active elements at the peripheries of TiC particles, impairing or destroying the ability of the affected particles to nucleate aluminium crystals. Further studies by the inventors have indicated that this poisoning effect is caused by the TiC particles reacting with the melt to form a sheathing of $Al_4C_3$ and $Ti_3AlC$. However, if this does occur, the affected particles can be decontaminated, by subjecting the melt to further holding at a suitable higher degree of superheating before casting, so as to provide favourable thermodynamic conditions for the rejuvenation of the affected particles. Preferred holding temperatures for this purpose are within the range 1300 to 1400 degrees C., holding for 5 to 10 minutes being generally sufficient.

EXAMPLE 2

Three further AlTiC alloys were made generally as described in Example 1, but having different carbon contents. Samples of the resulting three alloys, as well as that made in Example 1, were analysed for carbon and titanium, in each case both as carbide and in free form, and the results are shown in Table I below. The calculated free carbon values were calculated, on thermodynamic principles, for the situation where equilibrium has been reached.

TABLE I

| | Ti % | | | C % | | | |
|---|---|---|---|---|---|---|---|
| Master alloy | total | carbide | excess | total | carbide | free* $\times 10^{-3}$ | free+ $\times 10^{-3}$ |
| Al—5% Ti—0.5% C | 4.91 | 1.632 | 3.278 | 0.41 | 0.408 | 2.0 | 0.83 |
| Al—6% Ti—1.0% C | 5.64 | 3.244 | 2.396 | 0.82 | 0.811 | 9.0 | 1.13 |
| Al—7% Ti—1.5% C | 7.25 | 5.712 | 1.538 | 1.44 | 1.428 | 12.0 | 1.76 |
| Al—8% Ti—2.0% C | 7.88 | 7.204 | 0.676 | 1.82 | 1.801 | 19.0 | 4.00 |

*found
+calculated

It will be seen that the percentage of the total carbon content present which was free carbon varied from about 0.5% by weight in the case of Al-5% Ti-0.5% C to about 1% by weight in the case of Al-8% Ti-2.0% C. Thus, it is easily possible to produce alloys in accordance with the invention in which at least 95% (or indeed at least 98% or more) of the added carbon is in carbide form.

EXAMPLE 3

The hardener alloys prepared as above can be used to grain refine aluminium and its alloys by methods generally employed in foundries. The following examples show typical results of grain refinement tests. To each 100 g melt of commercially pure aluminium (99.7%) different amounts (0.05–0.2%) of Al-6% Ti-1% C master alloy additions resulted in the cast macrostructures as shown in FIG. 1, which also shows the effect when no grain refinement was used. The temperature of each melt was 725 degrees C., the holding time after the addition of grain refiner was 5 minutes, and the melt was cast in a water cooled steel mould of 40 mm diameter and 35 mm height. The castings were sectioned at a height of 15 mm from the bottom, polished and etched to reveal grain boundaries. For comparison, similar experiments were performed with equivalent additions of commercial Al-6% Ti grain refiner of rod form. The macrostructures of the latter castings are also shown in FIG. 1. It can be seen that the master alloy Al-6% Ti-1% C prepared in the laboratory is much superior to the commercial Al-6% Ti grain refiner in respect of grain refining efficiency. Grain density across the castings was found to increase rapidly with additions of Al-Ti-C C master alloys. An average grain size of 164 microns can be obtained by adding 0.2% of Al-6% Ti-1% C master alloy and casting the resulting melt as described above.

FIG. 2 shows cast macrostructures of Al-Zn-Mg alloy (ASTM 7075) to which 0.05–0.2% of Al-6% Ti-1.2% C were added under similar casting conditions as those of the test to which FIG. 1 relates. The grain size rapidly decreased with increasing additions of the master alloys even though the treated alloy contained 0.1% Zr and 0.2% Cr: these two elements, especially zirconium, both tend to poison Al-Ti-B grain refiners.

We claim:

1. A method of producing an alloy containing titanium carbide particles, the method comprising thoroughly dispersing preheated finely divided carbon powder particles into a metal melt in the presence of titanium, the said carbon powder particles being substantially above ambient temperature when introduced into the metal melt, causing the dispersed carbon particles to react with titanium within the metal melt so as to produce a dispersion of fine particles comprising titanium carbide within the metal melt, and thereafter solidifying the metal melt.

2. A method according to claim 1, wherein the carbon powder is introduced into the metal melt under such conditions that the carbon powder particles are wetted by the metal melt.

3. A method according to claim 1, wherein the carbon powder is at 700–900 degrees C. when introduced into the melt.

4. A method according to claim 3, wherein the carbon powder is at about 800 degrees C. when introduced into the melt.

5. A method according to claim 1, wherein the carbon powder is held substantially above ambient temperature for at least 0.5 hours before introduction into the melt.

6. A method according to claim 1, wherein the melt is subjected to vigorous stirring during introduction of the carbon powder into the melt.

7. A method according to claim 6, wherein sufficient stirring is provided to generate one or more vortices in the melt.

8. A method according to claim 6, wherein the titanium is present in an amount at least sufficient to react with all of the carbon particles, and the metal melt is stirred at least until substantially no free carbon remains in the metal melt.

9. A method according to claim 1, wherein the carbon powder is introduced into the melt through a clean metal melt surface.

10. A method according to claim 1, wherein the carbon powder is introduced into the melt in the form of graphite powder.

11. A method according to claim 1, wherein the carbon powder introduced into the metal melt has an average particle size less than 50 microns.

12. A method according to claim 11, wherein the carbon powder introduced into the metal melt has an average particle size of about 20 microns.

13. A method according to claim 1, wherein the carbon powder is introduced into the metal melt over an extended period of time.

14. A method according to claim 1, wherein the carbon powder is introduced into the metal melt wrapped in a foil of a metal which is not deleterious to the metal melt.

15. A method according to claim 1, wherein the total amount of carbon introduced by means of the carbon powder and chemically combined into the alloy is greater than 1000 ppm, by weight.

16. A method according to claim 15, wherein the said total amount of carbon is at least 1 weight %.

17. A method according to claim 15, wherein the said total amount of carbon is at least 3 weight %.

18. A method according to claim 1, wherein the metal melt is aluminium-based.

19. A method according to claim 1, wherein the alloy produced comprises 3 to 15 weight % titanium (including that which has reacted with the carbon powder), and 0.3 to 3 weight % reacted carbon.

20. A method according to claim 1, wherein the alloy produced comprises 3 to 15 weight % titanium (including that which has reacted with the carbon powder), 0.3 to 3 weight % reacted carbon, balance aluminium and incidental impurities.

21. A method according to claim 20, wherein the alloy produced comprises about 6 weight % titanium (including that which has reacted with the carbon powder), about 1 weight % reacted carbon, balance aluminium and incidental impurities.

22. A method according to claim 1, wherein the particles formed as a result of reaction of the carbon powder particles are substantially of sub-micron size.

23. A method according to claim 1, wherein at least 95% by weight of the carbon in the alloy has reacted with the titanium in the melt.

24. A method according to claim 1, wherein the melt is held at a suitable degree of superheating to produce decontamination of contaminated titanium carbide particles which may be present in the melt.

25. A method according to claim 24, wherein holding to produce decontamination is at a temperature of from 1300 to 1400 degrees C. for at least 5 minutes.

26. A method of grain refining an aluminium-based metal, by treating a melt of the metal with an alloy produced by a method in accordance with claim 1, and allowing the treated melt to solidify so that carbide particles from the alloy cause refinement of the structure of the thus-treated metal.

27. A method according to claim 26, wherein the aluminium-based metal contains one or more constituents which tend to poison Al-Ti-B grain refiners.

28. A method according to claim 27, wherein the aluminium-based metal contains at least one of: zirconium, chromium or manganese.

29. The method of claim 1 wherein the carbon powder particles have an average particle size less than 50 microns, the carbon powder particles have been held at a temperature of at least 700 degrees C. over a period of at least 0.5 hour before dispersing into the metal melt, the carbon powder particles are at a temperature of at least 700 degrees C. when dispersed into the metal melt, the metal melt is subjected to vigorous stirring during introduction of the carbon powder particles, the titanium is present in an amount which is at least sufficient to react with all of the carbon power particles, and the metal melt is stirred until substantially no free carbon remains in the metal melt.

* * * * *